US009116477B2

(12) United States Patent
Kang et al.

(10) Patent No.: US 9,116,477 B2
(45) Date of Patent: Aug. 25, 2015

(54) FIXING UNIT WITH A PRESSURE RELEASING MEMBER AND IMAGE FORMING APPARATUS HAVING THE SAME

(71) Applicant: SAMSUNG ELECTRONICS CO., LTD., Suwon-si, Gyeonggi-do (KR)

(72) Inventors: Sung Woo Kang, Suwon-si (KR); Jin Gue Ko, Seoul (KR); Hyun Joon Keum, Suwon-si (KR); Seung Jun Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 215 days.

(21) Appl. No.: 13/721,208

(22) Filed: Dec. 20, 2012

(65) Prior Publication Data

US 2014/0133872 A1 May 15, 2014

(30) Foreign Application Priority Data

Nov. 9, 2012 (KR) ..... 10-2012-0126933

(51) Int. Cl.
*G03G 15/20* (2006.01)

(52) U.S. Cl.
CPC ..... *G03G 15/2028* (2013.01); *G03G 15/2064* (2013.01)

(58) Field of Classification Search
None
See application file for complete search history.

(56) References Cited

U.S. PATENT DOCUMENTS

2008/0179823 A1* 7/2008 Yuzawa et al. ..... 271/225
2012/0148320 A1* 6/2012 Han et al. ..... 399/331

FOREIGN PATENT DOCUMENTS

JP 2008-250172 * 10/2008 ..... G03G 15/20

* cited by examiner

*Primary Examiner* — Clayton E Laballe
*Assistant Examiner* — Peter L Cheng
(74) *Attorney, Agent, or Firm* — Staas & Halsey LLP

(57) ABSTRACT

A fixing unit which may be disposed in an image forming apparatus includes a heating roller, at least one pressure roller being in pressure contact with the heating roller to form a nip together with the heating roller, and a pressure releasing member partially restricting application of pressure to the nip. The nip includes an effective fixing section used for fixing. The pressure releasing member includes a pair of pressure releasing parts inserted into sections of the nip other than the effective fixing section, a connection part connecting the pair of pressure releasing parts, and guide parts extending from the connection part in the same direction as the pair of pressure releasing parts. The pressure releasing member prevents deformation of a portion of an elastic layer formed on the heating roller which corresponds to the effective fixing section.

27 Claims, 5 Drawing Sheets

FIXING UNIT WITH A PRESSURE RELEASING MEMBER AND IMAGE FORMING APPARATUS HAVING THE SAME

CROSS-REFERENCE TO RELATED APPLICATIONS

This application claims the priority benefit of Korean Patent Application No. 10-2012-0126933, filed on Nov. 9, 2012 in the Korean Intellectual Property Office, the disclosure of which is incorporated herein by reference.

BACKGROUND

1. Field

Embodiments disclosed herein relate to a fixing unit which fixes developers transferred to a printing medium to the printing medium and an image forming apparatus having the same.

2. Description of the Related Art

Image forming apparatuses form an image on a printing medium according to an input signal, and may include a printer, a facsimile, and a multi-function apparatus having combined functions thereof.

An image forming apparatus includes a paper feeding unit in which printing media are stored, an image carrier unit including an image carrier on which an electrostatic latent image is formed, developing units supplying developers to the electrostatic latent image on the image carrier to develop the electrostatic latent image with the developers, an exposure unit forming the electrostatic latent image on the changed image carrier, a transfer unit transferring the developers on the image carrier to a printing medium, and a fixing unit applying heat and pressure to the printing medium to which the developers have been transferred to fix the developers to the printing medium.

Among the above components, the fixing unit generally includes a heating roller including a heater generating heat and a pressure roller being in pressure contact with the heating roller to form a nip. When the printing medium to which developers have been transferred passes through the nip, heat and pressure are applied to the printing medium to which developers have been transferred, and thus the developers are fixed to the printing medium.

SUMMARY

Therefore, it is an aspect of the present invention to provide a fixing unit which prevents deformation of the outer circumferential surface of a heating roller generated when pressure is applied to the outer circumferential surface of the heating roller for a long time by a pressure roller, and an image forming apparatus having the fixing unit.

Additional aspects of the invention will be set forth in part in the description which follows and, in part, will be apparent from the description, or may be learned by practice of the invention.

In accordance with one aspect of the present invention, a fixing unit includes a heating roller, at least one pressure roller being in pressure contact with the heating roller and forming a nip together with the heating roller, and a pressure releasing member partially restricting application of pressure to the nip, wherein the nip includes an effective fixing section used for fixing, and the pressure releasing member includes a pair of pressure releasing parts inserted into sections of the nip other than the effective fixing section, a connection part connecting the pair of pressure releasing parts, and guide parts extended from the connection part in the same direction as the pair of pressure releasing parts.

The nip may further include a passing section which includes the effective fixing section and through which a printing medium passes, and non-passing sections through which the printing medium does not pass, and the pair of pressure releasing parts may be inserted into the non-passing sections.

The guide parts may be folded to form a designated angle with the connection part to prevent the connection part from entering the nip.

The at least one pressure roller may include a main pressure roller having a relatively large diameter and a sub-pressure roller having a relatively small diameter, and the pair of pressure releasing parts may be inserted into sections of a nip formed between the heating roller and the sub-pressure roller other than the effective fixing section.

The guide parts may be folded and collide with or contact the sub-pressure roller.

The heating roller may include an elastic layer formed of an elastically deformable material and forming the outer circumferential surface of the heating roller, and the nip may be formed between the elastic layer and the at least one pressure roller.

The fixing unit may further include exit guide rollers guiding discharge of a printing medium, and the width of the connection part may be greater than a distance between the nip and the exit guide rollers.

The fixing unit may further include an actuator to sense whether or not a jam between the heating roller and the at least one pressure roller occurs, and the pressure releasing member may further include a cavity formed on the connection part at a position corresponding to the actuator.

The pressure releasing member may be formed of a flexible material.

The nip may have a thickness of about 2 mm, and the pressure releasing member may have a thickness of about 0.4 mm.

The extension length of the guide parts may be not less than the extension length of the pair of pressure releasing parts.

In accordance with another aspect of the present invention, an image forming apparatus includes a fixing unit fixing developers on a printing medium to the printing medium, wherein the fixing unit includes a heating roller, at least one pressure roller being in pressure contact with the heating roller and forming a nip together with the heating roller, and a pressure releasing member partially restricting application of pressure to the nip, wherein the nip includes an effective fixing section used for fixing, and the pressure releasing member includes a pair of pressure releasing parts inserted into sections of the nip other than the effective fixing section, a connection part connecting the pair of pressure releasing parts, and at least one guide part extended from the connection part in the same direction as the pair of pressure releasing parts.

In accordance with another aspect of the present invention, a fixing unit may include a heating roller, at least one pressure roller in pressure contact with the heating roller, to form a nip between the heating roller and the at least one pressure roller, and a pressure releasing member inserted into the nip to relieve pressure to the nip. The pressure releasing member may include a pair of pressure releasing parts disposed at opposite ends of the pressure releasing member which are inserted into opposite ends of the nip, a connection part connecting the pair of pressure releasing parts, and at least one guide part disposed between the pressure releasing parts to contact the at least one pressure roller when the pressure releasing member is inserted into the nip.

The nip may include a passing section through which a printing medium passes, an effective fixing section through which developers transferred to the printing medium are effectively fixed to the printing medium due to heat and pressure applied by the heating roller and at least one pressure roller, and non-passing sections disposed adjacent to each side of the passing section, wherein the pair of pressure releasing parts are disposed at a section other than the effective fixing section and at one or more of the passing section and non-passing sections.

The fixing unit may further include an actuator to sense whether a jam between the heating roller and the at least one pressure roller occurs, and the pressure releasing member may further include a cavity formed between two guide parts extending from the connection part, at a position corresponding to the actuator.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
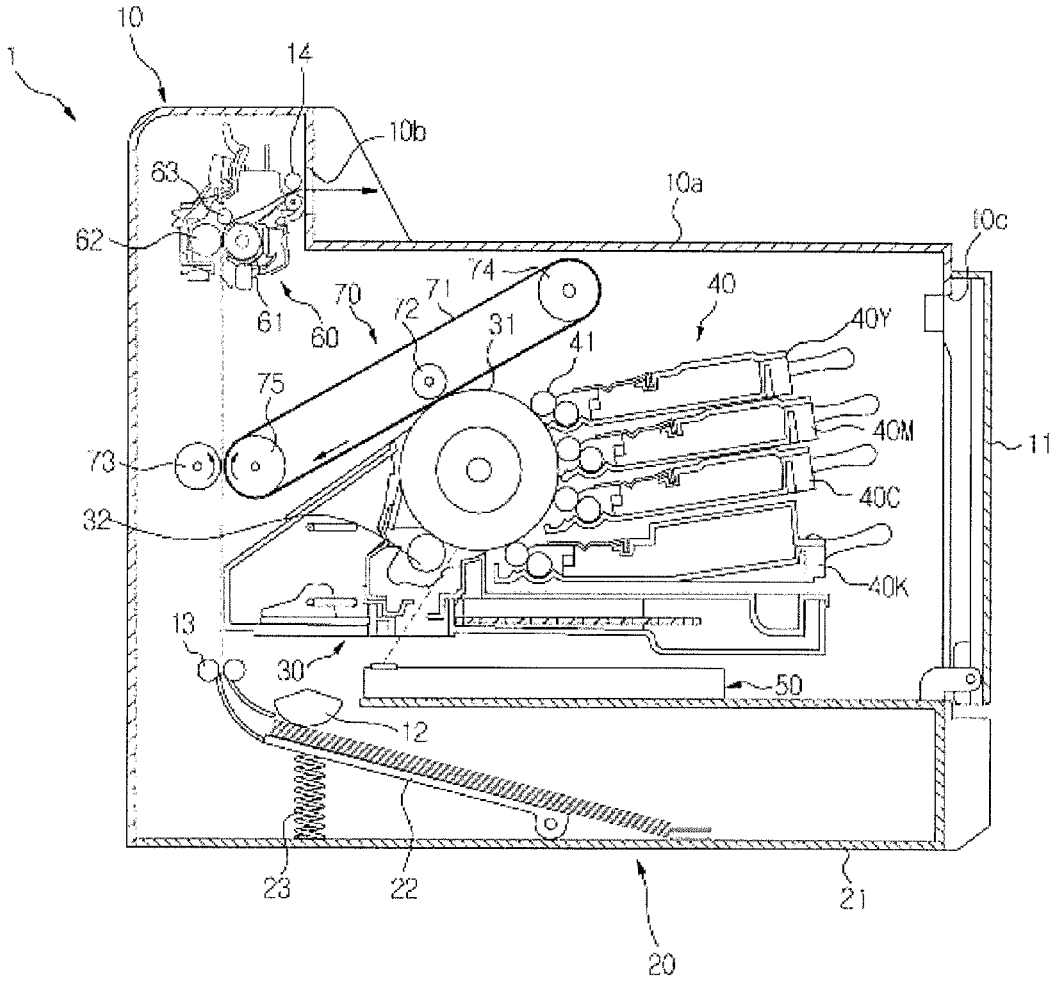
FIG. 1 is a cross-sectional view of an image forming apparatus in accordance with one embodiment of the present invention.

Reference will now be made in detail to the embodiments of the present invention, examples of which are illustrated in the accompanying drawings, wherein like reference numerals refer to like elements throughout.

Hereinafter, an image forming apparatus in accordance with one embodiment of the present invention will be described with reference to the accompanying drawings.

The image forming apparatus 1 in accordance with this embodiment, as shown in FIG. 1, includes a main body 10 forming the external appearance of the image forming apparatus, a paper feeding unit 20 in which printing media may be stored, an image carrier unit 30 including an image carrier 31 on which an electrostatic latent image is formed, one or more developing units 40 supplying developers to the electrostatic latent image formed on the image carrier 31 to develop the electrostatic latent image formed on the image carrier 31, an exposure unit 50 irradiating light to the charged image carrier 31 to form the electrostatic latent image on the image carrier 31, a transfer unit 70 transferring the developers formed on the image carrier 31 to a printing medium, and a fixing unit 60 applying heat and pressure to the printing medium to which the developers have been transferred to fix the developers to the printing medium. The printing medium used by the image forming apparatus may include printing paper sheets such as glossy paper, plain paper, art paper, overhead projector film, and the like.

A loading part 10*a* on which printing media having completed image formation are loaded may be provided on the upper portion of the main body 10, and an exit hole 10*b* through which the printing media having completed image formation are discharged may be provided at one side of the loading part 10*a*. For example, when a printing medium is discharged from exit rollers 14, consecutively discharged printing mediums may be stacked in a predetermined order on the loading portion 10*a*. An opening 10*c* to replace the developing units 40 or to perform maintenance on other components may be formed at one side of the main body 10, and a cover 11 to open and close the opening 10*c* may be installed. That is, the opening 10*c* may allow a user to access various components disposed within the image forming apparatus 1 to remove and/or replace components as needed, perform maintenance, or clear paper jams for example.

The paper feeding unit 20 may include one or more paper feeding cassettes 21 which are installed therein. The paper feeding cassettes 21 may be moveable in forward and reverse directions to allow a user to access various components (e.g., the printing medium) to remove and/or replace components (e.g., the printing medium) as needed, perform maintenance, or clear paper jams for example. A user may move the paper feed cassette 21 toward the main body 10 and or away from the main body 10, and a knock-up plate 22 disposed in the paper feeding cassette 21 may be provided such that printing media are loaded on the knock-up plate 22. An elastic member 23 may be provided below the knock-up plate 22 to elastically support the knock-up plate 22. The elastic member 23 may be a spring, for example.

The image carrier unit 30 includes the image carrier 31 on which the electrostatic latent image is formed by the exposure unit 50 so that the electrostatic latent image is developed by the developers supplied from the developing units 40. The image carrier unit 30 further includes a charge roller 32 charging the image carrier 31 with a designated electric potential. As shown in FIG. 1, the exposure unit 50 may be positioned below the image carrier unit 31. For example, light may be transmitted from the exposure unit 50 to the image carrier 31 in an upward diagonal direction, substantially along a path as shown by the dashed lines in FIG. 1. However, the disclosure is not limited to this embodiment, and the exposure unit 50 may be positioned elsewhere in the image forming apparatus 1 so long as the desired functionality of the exposure unit 50 may be achieved.

The developing units 40 may include four developing units 40Y, 40M, 40C and 40K respectively accommodating developers of different colors, e.g., developers of yellow (Y), magenta (M), cyan (C) and black (K). The respective developing units 40Y, 40M, 40C and 40K include developing rollers 41 supplying the corresponding developers to the image carrier 31 to develop the electrostatic latent image on the image carrier 31 with the developers. The transfer unit 70 includes an intermediate transfer belt 71 receiving the developers on the image carrier 31 and transferring the developers to a printing medium. The transfer unit 70 also includes a first transfer roller 72 disposed opposite the image carrier 31 such that the intermediate transfer belt 71 is interposed therebetween and the developers on the image carrier 31 are transferred to the intermediate transfer belt 71, a second transfer roller 73 disposed opposite a support roller 75, which will be described later, such that the intermediate transfer belt 71 is interposed therebetween and transfers the developers on the intermediate transfer belt 71 to the printing medium, and a pair of support rollers 74 and 75 supporting both sides of the inner surface of the intermediate transfer belt 71 and rotating the intermediate transfer belt 71. The exposure unit 50 irradiates light including image information to the image carrier 31 to form the electrostatic latent image on the surface of the image carrier 31.

Figure 2:
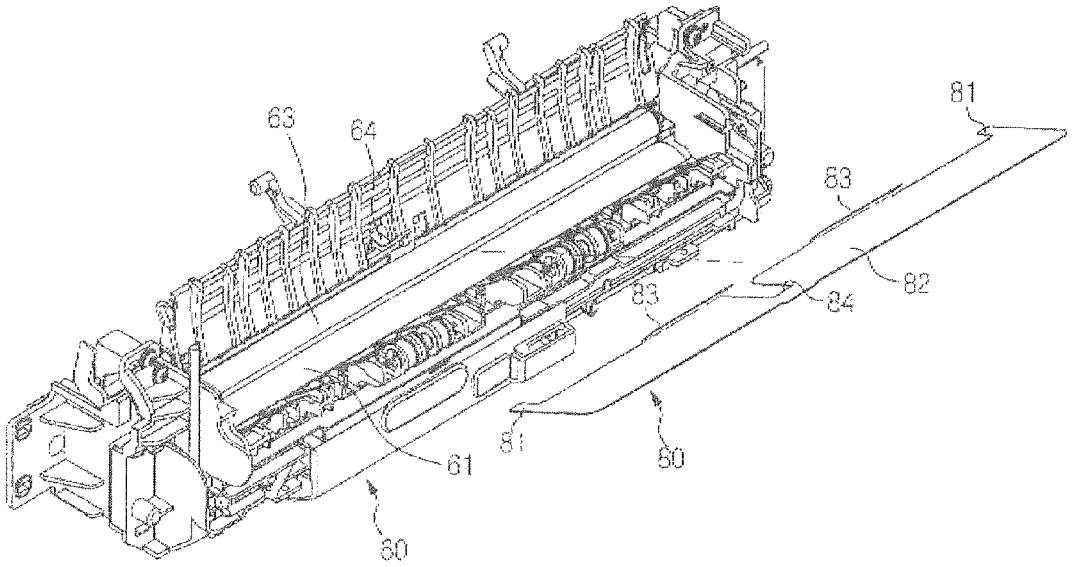
FIG. 2 is a perspective view of a fixing unit and a pressure releasing member applied to the image forming apparatus in accordance with the embodiment of the present invention.
Figure 3:
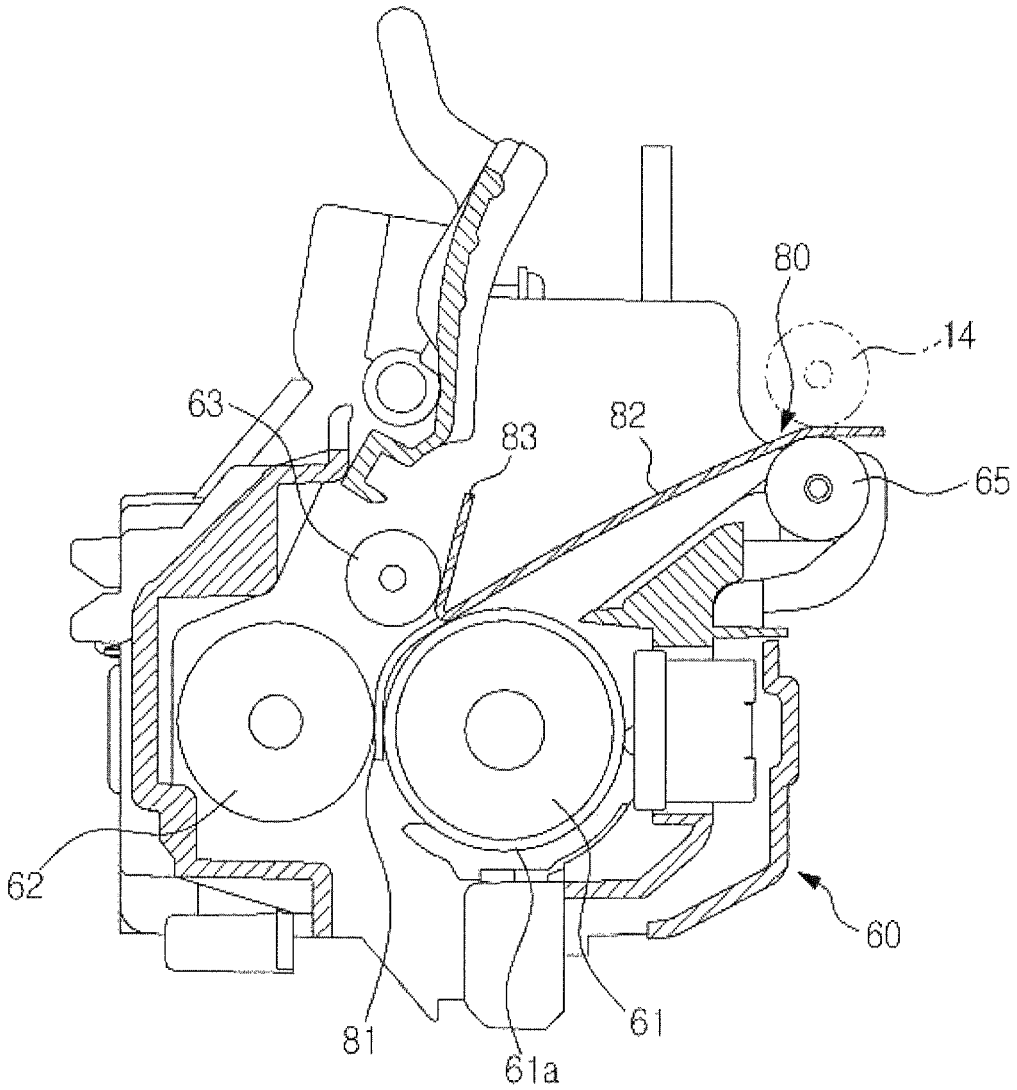
FIG. 3 is a cross-sectional view of the fixing unit and the pressure releasing member applied to the image forming apparatus in accordance with the embodiment of the present invention.

The fixing unit 60, as shown in FIG. 2 and FIG. 3, includes a heating roller 61 including a heater generating heat and applying the heat to a printing medium, and pressure rollers 62 and 63 being in pressure contact with the heating roller 61 and thus forming nips together with the heating roller 61. The heater may include, for example, a heat lamp (e.g., halogen lamp), heating coil, a resistive heating element, or other heating device. In this embodiment, the pressure rollers 62 and 63 include a main pressure roller 62 having a relatively large diameter and a sub-pressure roller 63 having a smaller diameter than the main pressure roller 62. The sub-pressure roller 63 may be formed of metal so as to have sufficient rigidity even with the small diameter.

Figure 5:
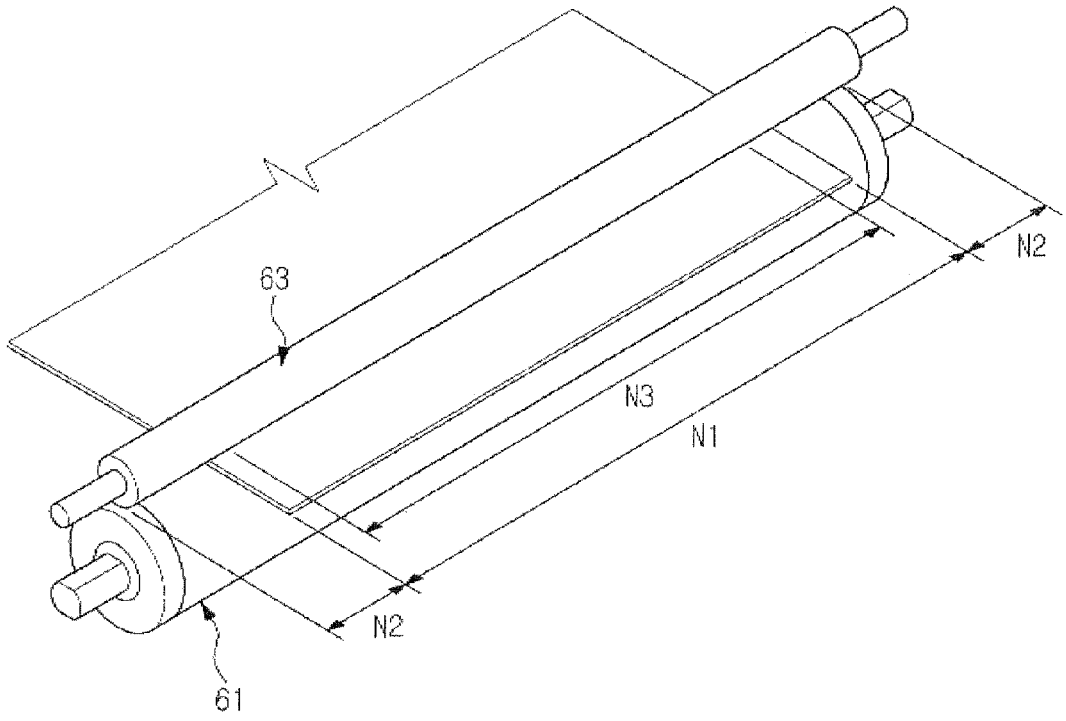
FIG. 5 is a perspective view illustrating a pressure contact state between a heating roller and a sub-pressure roller applied to the image forming apparatus in accordance with the embodiment of the present invention.

With reference to FIG. 5, the nip formed between the heating roller 61 and the sub-pressure roller 63 includes a passing section N1 through which the printing medium passes and non-passing sections N2 through which the printing medium does not pass and which are provided at both sides of the passing section N1. By way of example, the width of the passing section N1 together with the width of the non-passing sections N2 may correspond to a width of the sub-pressure roller 63 or heating roller 61. Additionally, the width of the passing section N1 may correspond to the width of the printing medium. Further, the passing section N1 includes an effective fixing section N3 corresponding to the developers which have been transferred to the printing medium passing through the passing section N1 and substantially used for fixing. As can be seen from FIG. 5, the width of the effective fixing section N3 may be less than the width of the passing section N1. Since the effective fixing section N3 inevitably has a width less than or equal to the width of the printing medium, the width of the effective fixing section N3 may be smaller than or equal to the width of the passing section N1. By way of example, an effective fixing section may refer to the section of the nip by which it is desired that the fixing unit 60 applies a required heat and pressure to the printing medium to which the developers have been transferred to effectively fix the developers to the printing medium. Sections of the nip other than the effective fixing section may not receive the same heat and pressure as the effective fixing section which may be required to attain a desired printing quality or performance. One of ordinary skill in the art would understand that the effective fixing section may be determined according to a desired printing quality or performance. Likewise, one of ordinary skill in the art would understand if sufficient pressure and heat is not applied to a printing medium which passes through the effective fixing section of the nip, fixing of the developers may be incompletely carried out and a desired printing quality or printing performance may not be achieved.

Therefore, when the printing medium passes through the passing section N1 of the nip formed between the heating roller 61 and the sub-pressure roller 63, heat and pressure are applied to the printing medium by the heating roller 61 and the sub-pressure roller 63, which are in pressure contact with each other, and thus the developers on the printing medium are fixed to the printing medium.

Further, in this embodiment, the fixing unit 60, as shown in FIG. 3, includes exit guide rollers 65 disposed opposite exit rollers 14 which will be described later. The exit guide rollers 65 and the exit rollers 14 cause the printing medium, which has just had the developers fixed to the printing medium while passing through the passing section N1 of the nip, to be discharged through the exit hole 10*b*.

Here, two exit guide rollers 65 may be separated from each other in the widthwise direction of the printing medium so as to stably discharge the printing medium. When the two exit guide rollers 65 are rotated under the condition that the two exit guide rollers 65 simultaneously contact both sides of the central portion of the printing medium, the printing medium may be discharged through the exit hole 10*b*. Likewise, there may be two exit rollers 14 disposed opposite respective exit guide rollers in the widthwise direction of the printing medium.

Within the main body 10, a pick-up roller 12 may be disposed above one side of the paper feeding unit 20 to pick up the printing media loaded on the knock-up plate 22 sheet by sheet. Further, feeding rollers 13 may be disposed on the feeding path of the printing media to guide the printing medium picked up by the pick-up roller 12 to the developing units 40 and the fixing unit 60, and the exit rollers 14 may be disposed adjacent to the exit hole 10*b* opposite the exit guide rollers 65 of the fixing unit 60 to cause the printing medium passing through the fixing unit 60 to be discharged through the exit hole 10*b*.

Among the above-described components, the heating roller 61, the main pressure roller 62 and the sub-pressure roller 63 disposed in the fixing unit 60 may have a length greater than the width of the printing medium passing through the fixing unit 60. Therefore, each of the nips formed between the heating roller 61 and the pressure rollers 62 and 63 includes a passing section N1 having a width corresponding to the width of the printing medium and non-passing sections N2 provided at both sides of the passing section N1, as described above.

The heating roller 61 includes an elastic layer 61*a* formed of an elastically deformable material, such as rubber, and forming the outer circumferential surface of the heating roller 61.

Further, the fixing unit 60 may include an actuator 64 rotatably installed and selectively protruding toward the feeding path of the printing media according to the rotating angle of the actuator 64, as shown in FIG. 2, and may sense whether or not a jam of the printing medium is generated in the fixing unit 60 through the actuator 64.

The image forming apparatus having the heating roller 61 including the elastic layer 61*a* on the outer circumferential surface thereof may not be used for a long time prior to initial use after shipping from a plant, and in this case, a portion of the elastic layer 61*a* forming the nip together with the sub-pressure roller 63 may be pressed by the sub-pressure roller 63 for a long time and thus may become deformed to a concave shape. If a printing medium passes through the passing section N1 of the nip formed between the deformed portion of the elastic layer 61*a* and the sub-pressure roller 63, pressure may not sufficiently be applied to the printing medium by the sub-pressure roller 63, and thus fixing of the developers may be incompletely carried out.

In order to prevent deformation of the elastic layer 61*a*, a pressure releasing member 80 to partially restrict application of pressure to the nip between the heating roller 61 and the sub-pressure roller 63 is inserted into the nip between the heating roller 61 and the sub-pressure roller 63 when the image forming apparatus is shipped. That is, the pressure releasing member 80 relieves pressure applied by the sub-pressure roller 63 to the heating roller 61.

Figure 4:
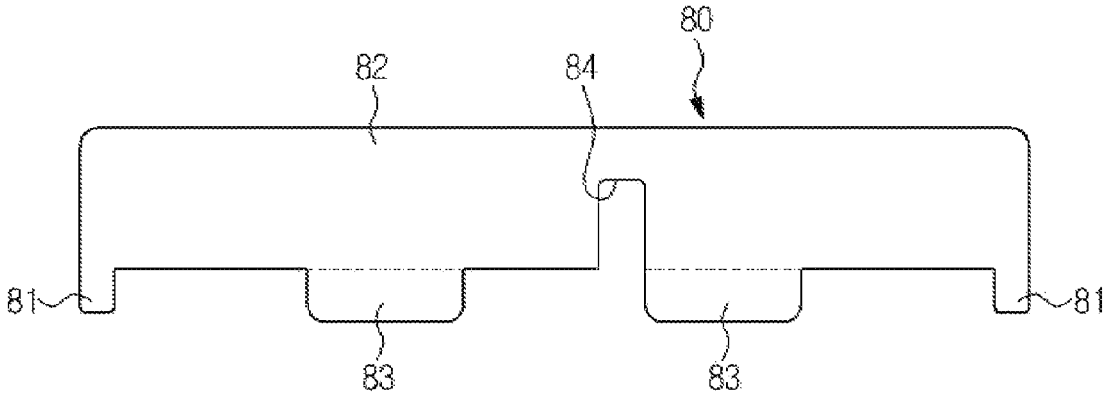
FIG. 4 is a plan view of the pressure releasing member applied to the image forming apparatus in accordance with the embodiment of the present invention.

The pressure releasing member 80, as shown in FIG. 4, includes a pair of pressure releasing parts 81 inserted into the non-passing sections N2 of the nip, and a connection part 82 connecting the two pressure releasing parts 81 and causing the two pressure releasing parts 81 to be simultaneously inserted into a space between the heating roller 61 and the sub-pressure roller 63 or separated from the space between the heating roller 61 and the sub-pressure roller 63. The two pressure releasing parts 81 are extended in one direction from both ends of the connection part 82. Therefore, when the pressure releasing parts 81 are inserted into the non-passing sections N2 of the nip, pressure applied to the non-passing sections N2 of the nip is removed, or is decreased to a very slight level even if such pressure is present. Therefore, deformation of the portion of the elastic layer 61*a* corresponding to the passing section N1 of the nip by pressure is prevented.

Further, the pressure releasing member 80 includes guide parts 83 extended in the same direction as the pressure releasing parts 81 integrally from the connection part 82. The guide parts 83 are foldable so as to form a designated angle with the pressure releasing parts 81, and serve to prevent entry of the connection part 82 of the pressure releasing member 80. That is, after the pressure releasing parts 81 of the pressure releasing member 80 are inserted into the non-passing sections N2 of the nip by a designated distance, the guide parts 83 collide with the sub-pressure roller 63 and thus the connection part 82 of the pressure releasing member 80 does not enter the non-passing sections N2 of the nip. For example, as can be seen in FIGS. 2-3, guide parts 83 may be folded in an upward vertical direction from the connection part 82, so as to be able to collide with the sub-pressure roller 63. Alternatively, guide parts 83 may be folded in a downward vertical direction from the connection part 82, so as to be able to collide with the heating roller 61, to thereby prevent the connection part 82 of the pressure releasing member 80 from entering the non-passing sections N2 of the nip. Although FIG. 2 and FIG. 4 show two guide parts 83, and the guide parts 83 may be of substantially equal width, the disclosure is not so limited. For example, there may be more than two guide parts 83, and the guide parts 83 may be of different widths than each other.

In one embodiment, the extension length of the guide parts 83 is not less than the extension length of the pressure releasing parts 81 so that the guide parts 83 guide discharge of the pressure releasing member 80 during initial operation of the image forming apparatus. A pair of guide parts 83 may be provided at positions corresponding to the above-described two exit guide rollers 65 so as to correspond to the exit guide rollers 65. By way of example, the guide parts 83 may have a width substantially equal to the width of the exit guide rollers. Through the above-described configuration, the guide parts 83 may contact the exit guide rollers 65 and thus receive force transmitted from the exit guide rollers 65 when the exit guide rollers 65 are rotated. Alternatively, if there are more than two exit guide rollers, additional guide parts may be provided which correspond to the exit guide rollers.

As described above, the actuator 64 may be disposed on the fixing unit 60. If the connection part 82 of the pressure releasing member 80 contacts the actuator 64, the actuator 64 is rotated by the connection part 82 of the pressure releasing member 80, and thus rotation of the actuator 64 may be misrecognized as generation of a jam in the fixing unit 60.

Therefore, the pressure releasing member 80 may include a cavity 84 formed on the connection part 82 at a position corresponding to the actuator 64 to prevent contact of the pressure releasing member 80 with the actuator 64. For example, the cavity 84 may be disposed in between the pair of guide parts 83. More specifically, as shown in FIG. 4, the cavity 84 may be formed such that an edge of a guide part 83 extending outward from the connection part 82 aligns with an edge of the cavity 84 extending inward from connection part 82. Therefore, in a state in which the pressure releasing parts 81 of the pressure releasing member 80 are inserted into the non-passing sections N2 of the nip, the actuator 64 is located within the cavity 84 formed on the connection part 82 and does not contact the connection part 82.

The pressure releasing member 80 has a designated thickness so that pressure is not applied to the passing section N1 of the nip, and is formed of a flexible material which may be folded or bent, such as paper. Alternatively, the pressure releasing member 80 may be formed of another material having similar properties (e.g., thickness, flexibility, weight), such as a plastic material.

The nip formed between the heating roller 61 and the sub-pressure roller 63 has a thickness of about 2 mm. It has been measured that pressing of the elastic layer 61*a* of the fixing unit 60 to about 0.14 mm is generated by the sub-pressure roller 63, if the pressure releasing member 80 is not installed. As a result of repeated testing, it is known that the thickness of the pressure releasing member 80 to prevent pressure from being applied from the fixing unit 60 to the passing section N1 of the nip should be about 0.4 mm.

Further, in this embodiment, the width of the connection part 82 of the pressure releasing member 80 may be greater than a distance between the nip between the heating roller 61 and the sub-pressure roller 63 and nips between the exit rollers 14 and the exit guide rollers 65. This serves to maintain a state in which the connection part 82 may be disposed between the exit rollers 14 and the exit guide rollers 65 under the condition that the pressure releasing parts 81 are inserted into the non-passing sections N2 of the nip.

Hereinafter, operation of the image forming apparatus having the above pressure releasing member will be described.

The pressure releasing member 80 may be installed on the fixing unit 60 before the manufactured image forming apparatus is shipped, for example. That is, the pressure releasing member 80 may be installed some time after manufacture of the image forming apparatus and some time before the image forming apparatus is initially used, to prevent deformation of the elastic layer 61*a* of the heating roller 61. In such a state, the pressure releasing parts 81 of the pressure releasing member 80 are inserted into the non-passing sections N2 of a nip, and thus pressure is scarcely applied to the passing section N1.

Therefore, even if the image forming apparatus is not used for a long time, the portion of the elastic layer 61*a* forming the passing section N1 of the nip is not deformed.

In the state in which the pressure releasing member 80 is installed in the fixing unit 60 when the image forming apparatus is manufactured and before it is shipped, the pressure releasing parts 81 of the pressure releasing member 80 are inserted into the non-passing sections N2 of the nip, as described above, and the connection part 82 is disposed between the exit rollers 14 and the exit guide rollers 65.

Therefore, when the exit rollers 14 and the exit guide rollers 65 are rotated by operation of the image forming apparatus, the pressure releasing member 80 receives force transmitted from the exit rollers 14 or the exit guide rollers 65 through the connection part 82, and thus the pressure releasing member 80 moves along the feeding path of the printing media in the main body 10 and is discharged through the exit hole 10*b* provided on the main body 10.

Here, since the guide parts 83 are provided at positions corresponding to the exit guide rollers 65 and have an extension length which is not less than the extension length of the pressure releasing parts 81, as described above, the ends of the guide parts 83 pass through the exit hole 10*b* simultaneously with the ends of the pressure releasing part 81 or later than the ends of the pressure releasing part 81. Therefore, the pressure releasing member 80 may be stably discharged to the loading part 10*a* through the exit hole 10*b*.

Pressure is applied again to the passing section N1 of the nip after discharge of the pressure releasing member 80, and the image forming apparatus is in a state in which pressure may be applied to a printing medium passing through the passing section N1 of the nip.

Although this embodiment describes the pressure releasing member 80 as being applied to the fixing unit 60 including the main pressure roller 62 and the sub-pressure roller 63, the pressure releasing member 80 may be applied to a fixing unit including one pressure roller.

Although this embodiment describes the pressure releasing parts 81 as being inserted into the non-passing sections N2 of the nip, the pressure releasing parts 81 may be inserted into other sections of the nip than the effective fixing section N3 as long as deformation of the elastic layer 61*a* in the effective fixing section N3 used for fixing may be prevented. For example, the pressure releasing parts 81 may be inserted partially into non-passing sections N2 and partially into passing section N1. Therefore, the length of the connection part 82 may be equivalent to or less than the length of the passing section N1 plus the length of the non-passing sections N2. Alternatively, the length of the connection part 82 may be equivalent to or less than the length of the heating roller 61 or the sub-pressure roller 63.

As is apparent from the above description, in an image forming apparatus in accordance with one embodiment of the present invention, pressure releasing parts of a pressure releasing member are inserted into non-passing sections of a nip when the image forming apparatus is shipped, thereby preventing pressure from being applied to a passing section of the nip and thus preventing deformation of the passing section of the nip. By preventing deformation of the elastic layer of the heating roller which corresponds to the passing section of the nip, a problem of insufficient pressure being applied to the printing medium by the sub-pressure roller is avoided. Therefore, printing performance and printing quality is improved since fixing of the developers to the printing medium is completely conducted.

The image forming apparatus may use one or more processors, which may include a microprocessor, central processing unit (CPU), digital signal processor (DSP), or application-specific integrated circuit (ASIC), as well as portions or combinations of these and other processing devices, to perform various functions of the image forming apparatus, according to the above-described example embodiments.

One of ordinary skill in the art would understand that the above-disclosed image forming apparatus may include a printer, a copy machine, a scanner, a facsimile, and a multifunctional device which incorporates two or more of the functionalities of the printer, the copy machine, the scanner, and the facsimile (which may be referred to as a multifunctional peripheral device or MFP). Additionally, the printer may have the capability for single-sided printing and/or duplex printing, and is not limited to the example embodiment of the printer shown in FIG. 1. Further, the printer may have one or more developing devices, and may include only a single developing device with a single color, or may include developing devices having a plurality of colors (e.g., yellow, magenta, cyan, black, orange, green, blue, red, etc.).

Although a few example embodiments of the present invention have been shown and described, it would be appreciated by those skilled in the art that changes may be made to these embodiments without departing from the principles and spirit of the invention, the scope of which is defined in the claims and their equivalents.

What is claimed is:

1. A fixing unit to fix developers on a printing medium to the printing medium, comprising:

a heating roller;

at least one pressure roller in pressure contact with the heating roller to form a nip between the heating roller and the at least one pressure roller; and a pressure releasing member to relieve pressure to the nip, wherein:

the nip includes an effective fixing section used for fixing; and the pressure releasing member includes a pair of pressure releasing parts inserted into sections of the nip other than the effective fixing section, a connection part connecting the pair of pressure releasing parts, and guide parts extended from the connection part in the same direction as the pair of pressure releasing parts and separated from the pair of pressure releasing parts in a widthwise direction of the printing medium, wherein the length of at least one of the guide parts is longer than the length of the pair of pressure releasing parts.

2. The fixing unit according to claim 1, wherein:

the nip further includes a passing section which includes the effective fixing section through which the printing medium passes, and non-passing sections through which the printing medium does not pass; and the pair of pressure releasing parts is inserted into the non-passing sections.

3. The fixing unit according to claim 1, wherein:

the heating roller includes an elastic layer formed of an elastically deformable material to form an outer circumferential surface of the heating roller; and the nip is formed between the elastic layer and the at least one pressure roller.

4. The fixing unit according to claim 1, further comprising exit guide rollers to guide a discharge of the printing medium, wherein the width of the connection part is greater than a distance between the nip and the exit guide rollers.

5. The fixing unit according to claim 1, further comprising an actuator which is used to sense whether a jam between the heating roller and the at least one pressure roller occurs, wherein the pressure releasing member further includes a cavity formed on the connection part at a position corresponding to the actuator.

6. The fixing unit according to claim 1, wherein the pressure releasing member is formed of a flexible material.

7. The fixing unit according to claim 1, wherein:

the nip has a thickness of about 2 mm; and the pressure releasing member has a thickness of about 0.4 mm.

8. The fixing unit according to claim 1, wherein the extension length of the guide parts is not less than the extension length of the pair of pressure releasing parts.

9. A fixing unit comprising:

a heating roller;

at least one pressure roller in pressure contact with the heating roller to form a nip between the heating roller and the at least one pressure roller; and a pressure releasing member to relieve pressure to the nip, wherein:

the nip includes an effective fixing section used for fixing; and the pressure releasing member includes a pair of pressure releasing parts inserted into sections of the nip other than the effective fixing section, a connection part connecting the pair of pressure releasing parts, and guide parts extended from the connection part in the same direction as the pair of pressure releasing parts, wherein the guide parts are folded to form a designated angle with the connection part to prevent the connection part from entering the nip.

10. The fixing unit according to claim 9, wherein:

the at least one pressure roller includes a main pressure roller having a first diameter and a sub-pressure roller having a second diameter, smaller than the first diameter; and the pair of pressure releasing parts is inserted into a nip formed between the heating roller and the sub-pressure roller at portions other than the effective fixing section.

11. The fixing unit according to claim 10, wherein the guide parts are folded and contacts the sub-pressure roller.

12. An image forming apparatus comprising a fixing unit to fix developers on a printing medium to the printing medium, wherein the fixing unit includes a heating roller, at least one pressure roller in pressure contact with the heating roller to form a nip between the heating roller and the at least one pressure roller, and a pressure releasing member to relieve pressure to the nip, wherein:

the nip includes an effective fixing section used for fixing; and the pressure releasing member includes a pair of pressure releasing parts inserted into sections of the nip other than the effective fixing section, a connection part connecting the pair of pressure releasing parts, and a plurality of guide parts extended from the connection part in the same direction as the pair of pressure releasing parts and separated from the pair of pressure releasing parts in a widthwise direction of the printing medium, wherein the length of at least one of the plurality of guide parts is longer than the length of the pair of pressure releasing parts.

13. The image forming apparatus according to claim 12, wherein:

the nip further includes a passing section which includes the effective fixing section through which the printing medium passes, and non-passing sections through which the printing medium does not pass; and the pair of pressure releasing parts is inserted into the non-passing sections.

14. The image forming apparatus according to claim 12, wherein:

the heating roller includes an elastic layer formed of an elastically deformable material which forms an outer circumferential surface of the heating roller; and the nip is formed between the elastic layer and the at least one pressure roller.

15. The image forming apparatus according to claim 12, wherein:

the fixing unit further includes at least one exit guide roller to guide a discharge of the printing medium; and the width of the connection part is greater than a distance between the nip, formed between the heating roller and the at least one pressure roller, and the at least one exit guide roller.

16. The image forming apparatus according to claim 15, wherein:

the at least one exit guide roller of the fixing unit includes a pair of exit guide rollers separated from each other in the widthwise direction of the printing medium; and the plurality of guide parts include a pair of guide parts extended from the central portion of the connection part and separated from each other so as to correspond to the pair of exit guide rollers.

17. The image forming apparatus according to claim 12, wherein:

the fixing unit further includes an actuator which is used to sense whether a jam between the heating roller and the at least one pressure roller occurs; and the pressure releasing member further includes a cavity formed on the connection part at a position corresponding to the actuator.

18. The image forming apparatus according to claim 12, wherein the pressure releasing member is formed of a flexible material.

19. The image forming apparatus according to claim 12, wherein:

the nip has a thickness of about 2 mm; and the pressure releasing member has a thickness of about 0.4 mm.

20. The image forming apparatus according to claim 12, wherein the extension length of at least one of the guide parts is not less than the extension length of the pair of pressure releasing parts.

21. An image forming apparatus comprising a fixing unit to fix developers on a printing medium to the printing medium, wherein the fixing unit includes a heating roller, at least one pressure roller in pressure contact with the heating roller to form a nip between the heating roller and the at least one pressure roller, and a pressure releasing member to relieve pressure to the nip, wherein:

the nip includes an effective fixing section used for fixing; and the pressure releasing member includes a pair of pressure releasing parts inserted into sections of the nip other than the effective fixing section, a connection part connecting the pair of pressure releasing parts, and at least one guide part extended from the connection part in the same direction as the pair of pressure releasing parts, wherein the at least one guide part is folded to form a designated angle with the connection part and prevents the connection part from entering the nip formed between the heating roller and the at least one pressure roller.

22. The image forming apparatus according to claim 21, wherein:

the at least one pressure roller includes a main pressure roller having a first diameter and a sub-pressure roller having a second diameter smaller than the first diameter; and the pair of pressure releasing parts is inserted into a nip formed between the heating roller and the sub-pressure roller at portions of the nip other than the effective fixing section.

23. The image forming apparatus according to claim 22, wherein the at least one guide part is folded and contacts the sub-pressure roller.

24. A fixing unit to fix developers on a printing medium to the printing medium, comprising:

a heating roller;

at least one pressure roller in pressure contact with the heating roller, to form a nip between the heating roller and the at least one pressure roller; and a pressure releasing member inserted into the nip to relieve pressure to the nip, wherein the pressure releasing member includes a pair of pressure releasing parts disposed at opposite ends of the pressure releasing member which are inserted into opposite ends of the nip, a connection part connecting the pair of pressure releasing parts, and at least two guide parts disposed between the pressure releasing parts and separated from the pair of pressure releasing parts in a widthwise direction of the printing medium to contact the at least one pressure roller when the pressure releasing member is inserted into the nip, wherein the length of at least one of the at least two guide parts is longer than the length of the pair of pressure releasing parts.

25. The fixing unit according to claim 24, wherein the nip comprises:

a passing section through which the printing medium passes, an effective fixing section through which developers transferred to the printing medium are effectively fixed to the printing medium due to heat and pressure applied by the heating roller and the at least one pressure roller, and non-passing sections disposed adjacent to each side of the passing section, wherein the pair of pressure releasing parts are disposed at a section other than the effective fixing section and at one or more of the passing section and non-passing sections.

26. The fixing unit according to claim 24, further comprising an actuator which is used to sense whether a jam between the heating roller and the at least one pressure roller occurs, wherein the pressure releasing member further includes a cavity formed between two guide parts extending from the connection part, at a position corresponding to the actuator.

27. A fixing unit comprising:

a heating roller;

at least one pressure roller in pressure contact with the heating roller to form a nip between the heating roller and the at least one pressure roller; and a pressure releasing member to relieve pressure to the nip, wherein:

the nip includes an effective fixing section used for fixing; and the pressure releasing member includes a pair of pressure releasing parts inserted into sections of the nip other than the effective fixing section, a connection part connecting the pair of pressure releasing parts, and guide parts extended from the connection part in the same direction as the pair of pressure releasing parts, wherein the length of the guide parts is longer than the length of the pair of pressure releasing parts.

* * * * *